US006013135A

United States Patent [19]

Kaun et al.

[11] Patent Number: 6,013,135

[45] Date of Patent: Jan. 11, 2000

[54] METHOD AND APPARATUS FOR SIX-SIDED VACUUM PAINTING OF PARTS

[75] Inventors: Robert H. Kaun; David J. Peterson, both of Woodbury, Minn.

[73] Assignee: Colonial Craft, Inc., St. Paul, Minn.

[21] Appl. No.: 09/070,862

[22] Filed: Apr. 30, 1998

[51] Int. Cl.[7] ..... C23L 16/00

[52] U.S. Cl. ..... 118/726; 118/729; 118/324; 156/345

[58] Field of Search ..... 118/726, 727, 118/729, 322, 324; 156/345

[56] References Cited

U.S. PATENT DOCUMENTS

| | | | |
|---|---|---|---|
| 3,584,847 | 6/1971 | Hammond et al. | 263/6 |
| 3,808,067 | 4/1974 | Brown | 156/3 |
| 4,465,416 | 8/1984 | Burkhalter et al. | 414/217 |
| 4,526,670 | 7/1985 | Hajj | 204/298 |
| 4,620,894 | 11/1986 | Gurian et al. | 156/345 |
| 5,679,160 | 10/1997 | Wallace et al. | 118/669 |

OTHER PUBLICATIONS

Addendum D. Vacuum Take–away System, p. 21, dated Dec. 27, 1994.

*Primary Examiner*—Bruce Breneman
*Assistant Examiner*—Erin Fieler
*Attorney, Agent, or Firm*—Nelson R. Capes; Mackall, Crounse & Moore, PLC

[57] ABSTRACT

A method for six-sided painting of parts, such as boards, the parts having a top, bottom, sides, and ends, in a vacuum painting system having a feed conveyor, a vacuum painting chamber, and a take-out conveyor wherein the a first part is placed end-to-end with a second part on the feed conveyor, each part having a leading end and a trailing end, and the first part and second part enter the vacuum painting chamber end-to-end, the parts exiting the vacuum painting chamber onto the take-out conveyor end-to-end with the leading end of each part exiting the vacuum painting chamber first, consisting of the steps of:

(a) sensing the presence of the leading end of the first part along the take-out conveyor while the trailing end of the first part is within the vacuum painting chamber;

(b) moving a movable carriage along the take-out conveyor toward the vacuum painting chamber to a position intermediate the leading end and trailing end of the first part;

(c) moving the movable carriage a short distance along the take-out conveyor away from the vacuum painting chamber in order to approximate the speed of the movable carriage to the speed of the take-out conveyor;

(d) gripping the first part with gripping means attached to the movable carriage;

(e) moving the movable carriage a short distance along the take-out conveyor away from the vacuum painting chamber in order to separate the trailing end of the first part from the leading end of the second part; and (f) releasing the first part so that the trailing end of the first part and the leading end of the second part become painted.

An apparatus for carrying out the above method is also disclosed, consisting of a sensor adjacent the take-out conveyor for sensing the leading end of the first part; a relay responsive to the sensor; a movable carriage adjacent the take-out conveyor and adapted to move in either direction along the take-out conveyor and positionable along the first part on the take-out conveyor, the motion of the movable carriage being responsive to the relay; and gripping pins mounted on the movable carriage for gripping the first part, the gripping pins being responsive to the relay.

23 Claims, 6 Drawing Sheets

70,74
72
80,84
82
40
32
92
34,36
38
90,94
10
P2
12
34
32
30
14
P1
E1
110
60
62
12
102
P1
30,30A
100,104

METHOD AND APPARATUS FOR SIX-SIDED VACUUM PAINTING OF PARTS

BACKGROUND OF THE INVENTION

This invention relates to an apparatus and method for six-sided board painting.

In manufacturing operations that produce millwork such as moldings, sills, frames, etc., it has been the practice to vacuum paint the workpiece on an assembly line. The stock is put in a bin and each piece is fed onto a conveyor line, with the pieces abutting each other end to end along the conveyor. Each piece enters a vacuum painting apparatus, where paint is sprayed onto the piece under a vacuum. The piece then exits the apparatus onto another conveyor to be dried and heat-treated.

In order to paint each piece on six sides, that is, the top, bottom, sides, and ends, it is necessary to keep each piece slightly separated from the following piece. If this were not done, the paint would not be able to reach the trailing end of the lead piece or the leading end of the following piece. Industry practice has been to insert a staple in the trailing end of the lead piece to separate this piece slightly from the following piece. When the boards have been painted, the staples must be removed.

Inserting and removing staples is a time-consuming, labor-intensive, potentially health-damaging operation. The constant twisting, gripping movement of removing the staples can cause such ailments as carpal tunnel syndrome.

In addition, the staples caused a partial loss of vacuum within the vacuum painting chamber because the boards were spaced apart as they entered the chamber. The gap between the boards caused a partial loss of vacuum because the seals of the vacuum painting chamber could not close tightly around the boards. This partial loss resulted in reduced painting efficiency and waste of paint. There are also environmental concerns if paint escapes from the vacuum chamber into the surrounding air.

Another earlier solution to the problem of painting the ends of the boards is the optional vacuum take-away system offered by Advanced Manufacturing and Development (AM&D) of Willitz, Calif. This system causes parts to separate in the application chamber, allowing the ends to be coated. However, the inventor has found that this vacuum take-away system leaves undesirable streaks on the boards. Indeed the operator'manual for this system states that the belts of the conveyor will cause transfer marks to the bottom side of the part when the bottom is being painted. The inventor has also found that this vacuum take-away system cannot operate well near the maximum speed of the conveyor.

There is a need for an apparatus for six-sided painting of parts such as boards, moldings, sills, and frames that allows the ends of the parts to be painted in a vacuum painting system and is adjustable for part size (length and width) and the speed of the conveyor.

SUMMARY OF THE INVENTION

A method for six-sided painting of parts, such as boards, the parts having a top, bottom, sides, and ends, in a vacuum painting system having a feed conveyor, a vacuum painting chamber, and a take-out conveyor wherein the a first part is placed end-to-end with a second part on the feed conveyor, each part having a leading end and a trailing end, and the first part and second part enter the vacuum painting chamber end-to-end, the parts exiting the vacuum painting chamber onto the take-out conveyor end-to-end with the leading end of each part exiting the vacuum painting chamber first, consisting of the steps of:

(a) sensing the presence of the leading end of the first part along the take-out conveyor while the trailing end of the first part is within the vacuum painting chamber;

(b) moving a movable carriage along the take-out conveyor toward the vacuum painting chamber to a position intermediate the leading end and trailing end of the first part;

(c) moving the movable carriage a short distance along the take-out conveyor away from the vacuum painting chamber in order to approximate the speed of the movable carriage to the speed of the take-out conveyor;

(d) gripping the first part with gripping means attached to the movable carriage;

(e) moving the movable carriage a short distance along the take-out conveyor away from the vacuum painting chamber in order to separate the trailing end of the first part from the leading end of the second part; and (f) releasing the first part so that the trailing end of the first part and the leading end of the second part become painted.

An apparatus for carrying out the above method is also disclosed, consisting of a sensor adjacent the take-out conveyor for sensing the leading end of the first part; a relay responsive to the sensor; a movable carriage adjacent the take-out conveyor and adapted to move in either direction along the take-out conveyor and positionable along the first part on the take-out conveyor, the motion of the movable carriage being responsive to the relay; and gripping pins mounted on the movable carriage for gripping the first part, the gripping pins being responsive to the relay.

DETAILED DESCRIPTION OF THE PREFERRED EMBODIMENTS

Figure 1:
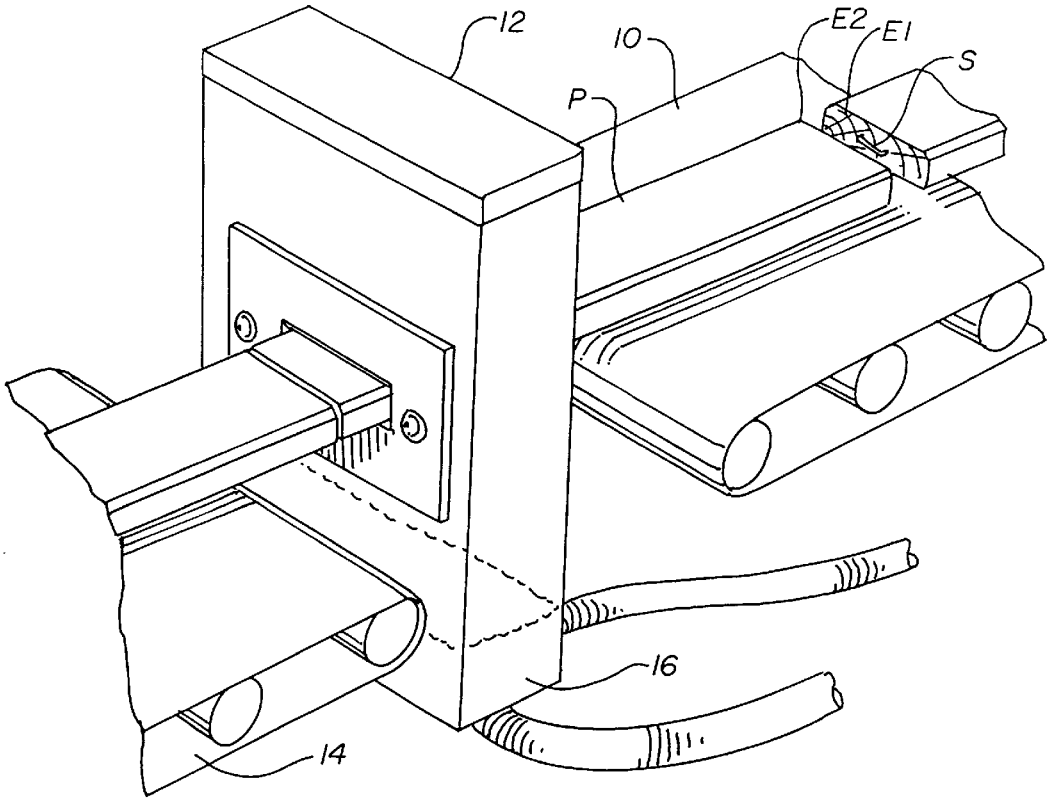
Fig. 1 PRIOR ART
FIG. 1 is a schematic of a vacuum painting system of the prior art.

FIG. 1 shows a vacuum painting system in which the present invention is used. The vacuum painting system consists of a feed conveyor 10, a vacuum painting chamber 12, and a take-out conveyor 14. Parts P are placed end-to-end on the feed conveyor 10. Each part P has a leading end E1 and a trailing end E2. For convenience of description, the processing of two parts, P1 and P2, referred to respectively as the "first part" and "second part", will be described.

To prepare the system for operation, paint or other coating is loaded into a reservoir 16 and a vacuum blower (not shown) is activated, causing the coating to be pumped into the base of the vacuum painting chamber 12. Due to the vacuum in the vacuum painting chamber 12, the coating is suctioned up, then vaporized.

The first part P1 enters the vacuum painting chamber 12 with its leading end E1 entering the chamber 12 first. As the part moves through the vacuum painting chamber 12, it is passed through the coating vapor and is coated.

The negative pressure created inside the vacuum painting chamber 12 by the vacuum blower pulls surrounding air into the chamber 12. When the part exits the vacuum painting chamber 12, the air passes through the small openings around the part at a controlled velocity and draws the excess coating back into the vacuum painting chamber 12. There is thus no loss to over spray or evaporation.

Figure 2:
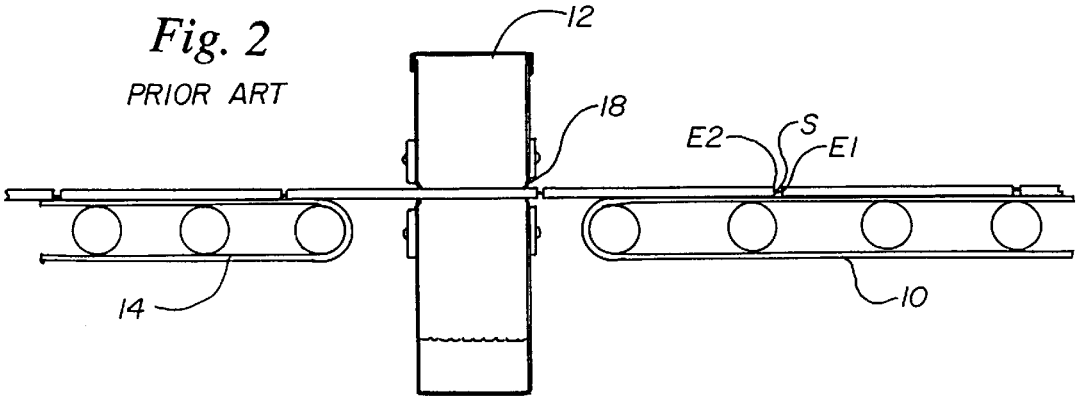
Fig. 2 PRIOR ART
FIG. 2 is a side elevational view of a vacuum painting system of the prior art.

However, in order to paint the ends (E1, E2) of the parts, the parts may not remain end-to-end within the vacuum painting chamber. Industry custom has therefore been to separate the ends (E1, E2) of the parts before the parts enter the vacuum painting chamber 12, as by inserting a staple S into the trailing end E2 of the first part or leading end E1 of the second part. See FIG. 2. This staple must be manually removed after the part is painted.

The insertion and removal of the staples S is a time-consuming, labor-intensive operation. Furthermore, repeated twisting motions required to remove the staples may cause ailments such as carpal tunnel syndrome.

Furthermore, the small space between the parts as the parts pass through the input seal 18 of the vacuum painting chamber may cause a partial loss of vacuum. This may cause reduced coating efficiency and coating may escape into the environment.

Figure 3A:
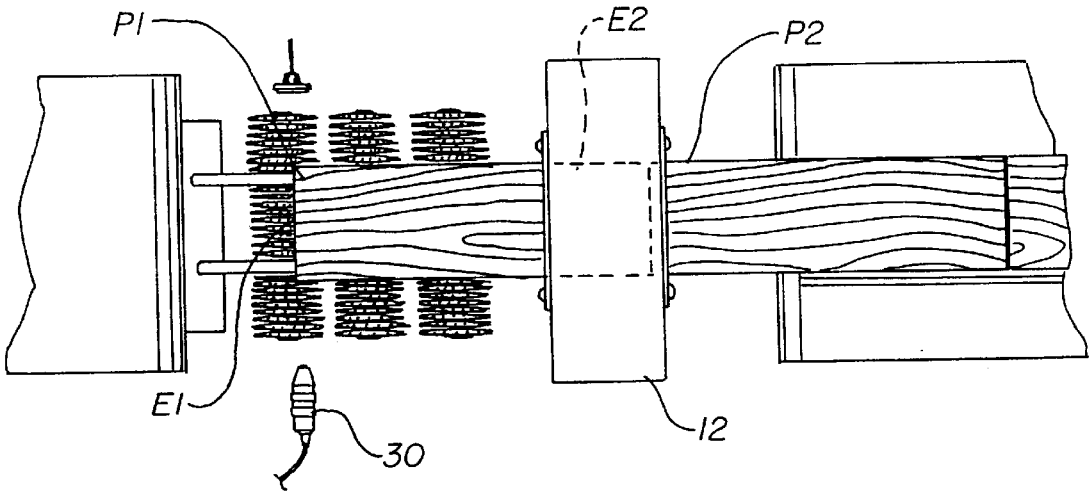
FIGS. 3*a*–3*f* are schematics illustrating the steps of the method of the present invention.

In the method of the present invention, illustrated beginning with FIG. 3*a*, a sensor 30 senses the presence of the leading end E1 of the first part P1 along the take-out conveyor 14 while the trailing end E2 of the first part P1 is within the vacuum painting chamber 12. In FIG. 3*a*, it should be noted that the trailing end E2 of part P1 abuts the leading end E1 of part P2.

Figure 3B:
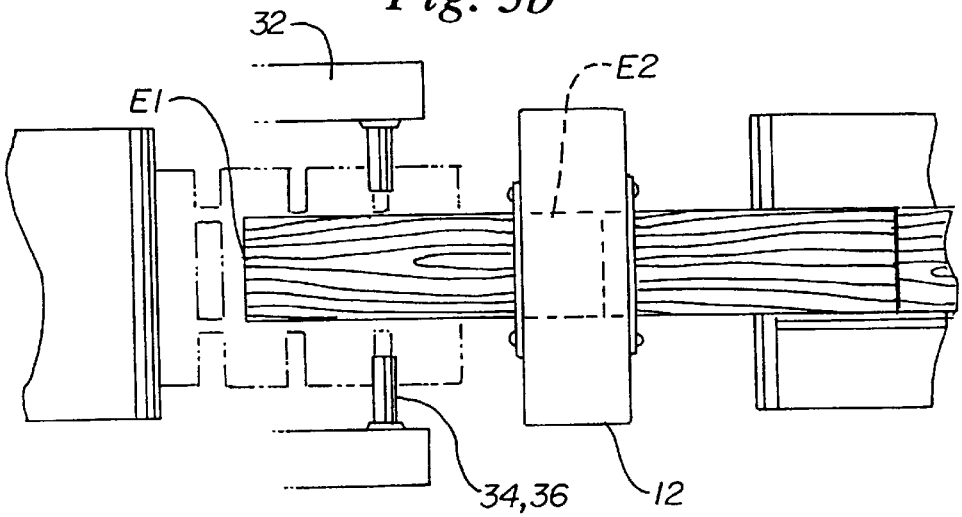

In the next step (FIG. 3*b*), a movable carriage 32 is moved along the take-out conveyor 14 toward the vacuum painting chamber 12 to a position intermediate the leading end E1 and trailing end E2 of part P1. The movable carriage 32 has a gripping means 34, such as pins 36, for gripping the part P1.

Figure 3C:
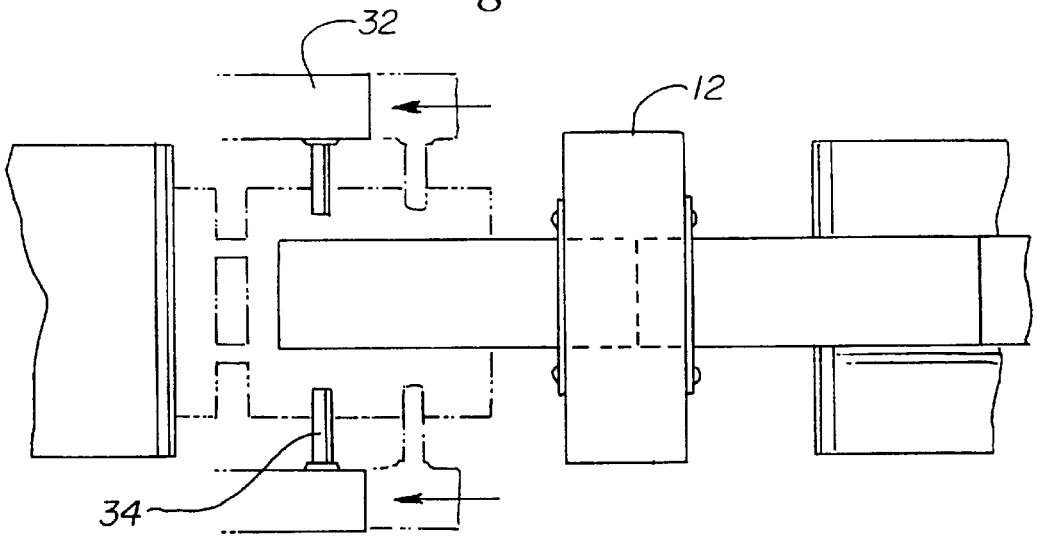

Next (FIG. 3*c*), the movable carriage 32 is moved a short distance along the take-out conveyor 14 away from the vacuum painting chamber 12 in order to approximate the speed of the movable carriage 32 to the speed of the take-out conveyor 14. The purpose of this is to avoid leaving streaks on the part after it is gripped.

Figure 3D:
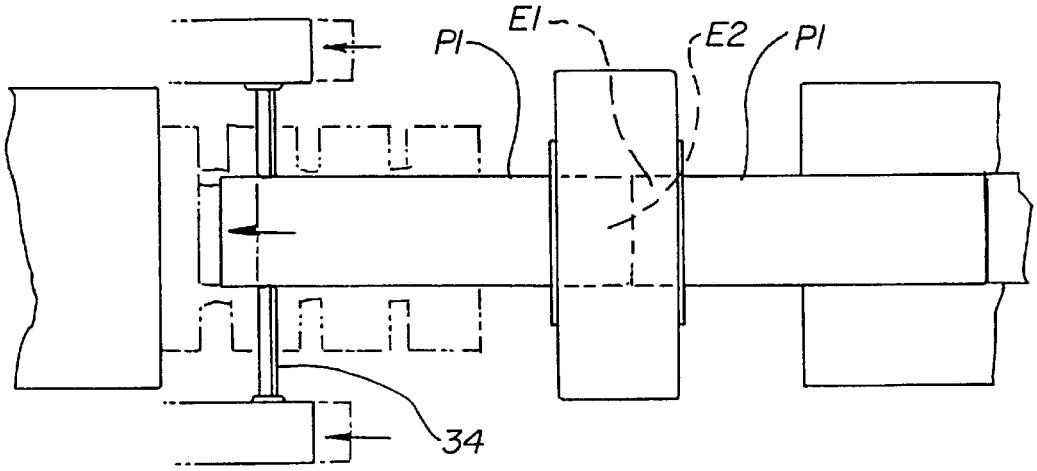

Next (FIG. 3*d*), the gripping means 34 grips the first part P1. Note that the trailing end E2 of the first part and leading end E1 of the second part still abut.

Figure 3E:
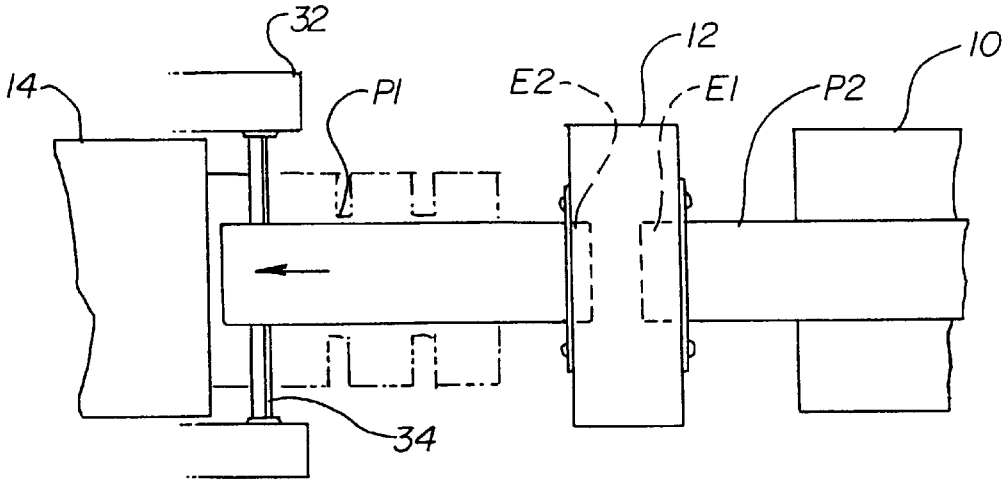

In FIG. 3*e*, it is seen that the carriage 32 moves a short distance along the take-out conveyor 14 away from the vacuum painting chamber 12 in order to separate the trailing end E2 of the first part P1 from the leading end E1 of the second part P2. The coating in the vacuum chamber now coats trailing end E2 and leading end E1.

Figure 3F:
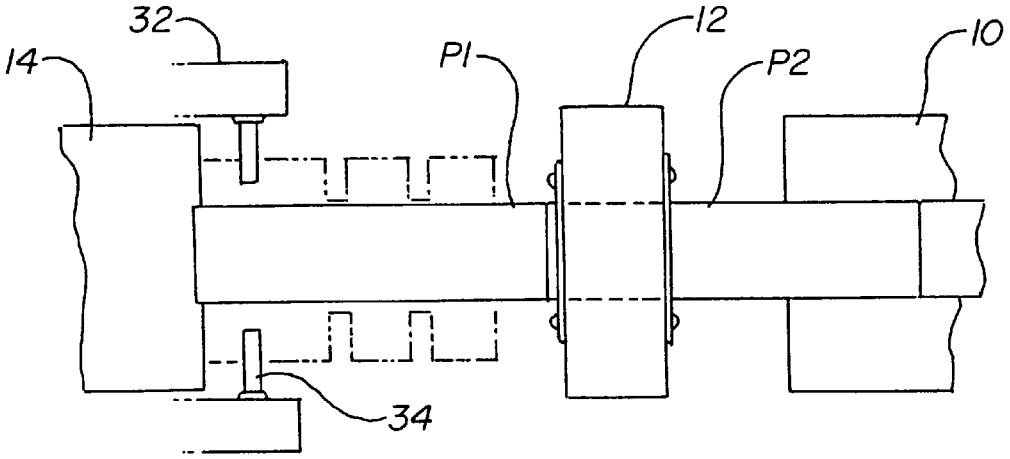

Finally (FIG. 3*f*), the gripping means 34 releases the first part P1. Motion of the feed conveyor 10 then causes part P2 to again abut part P1, and the two parts then exit the chamber 12 end-to-end.

Optionally, the movable carriage 32 and gripping means 34 may be placed on a movable frame and the frame may be moved from one take-out conveyor to another take-out conveyor. Thus, the same mechanism may be used in different production lines. Alternatively, multiple frames may be used, with one frame in production and the others being readied for use, such as by cleaning or adjustment.

The movable carriage may be adjusted vertically and horizontally in relation to the take-out conveyor and vacuum painting chamber to accommodate differences across production lines and different lengths and widths of parts.

Figures 4, 4A, 4B:
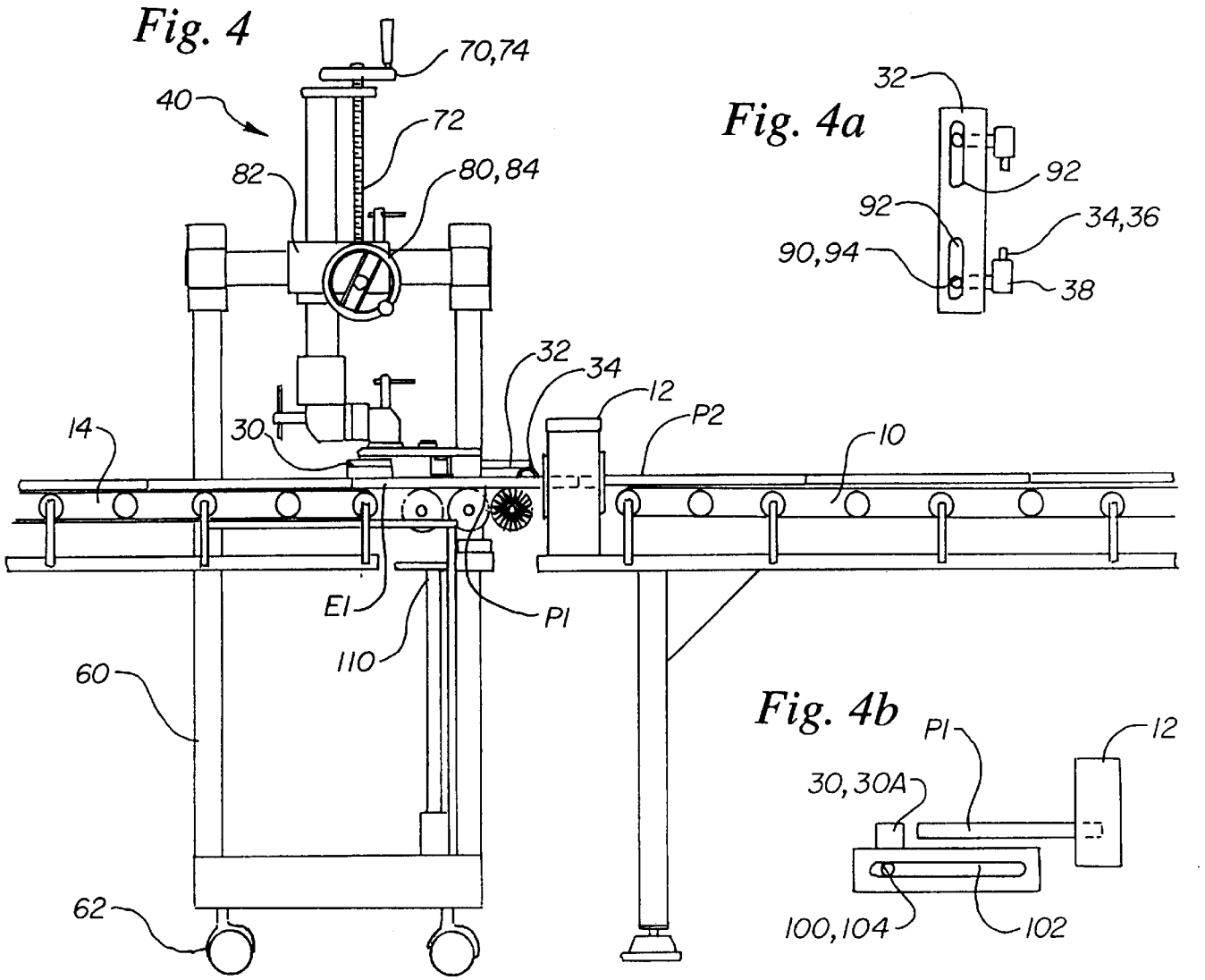
FIG. 4 is a schematic of the apparatus of the present invention.
FIG. 4A is a detailed schematic of one embodiment of a means for adjusting the separation of the grippers in relation to the part.
FIG. 4B is a detailed schematic of one embodiment of a means for adjusting the position of the sensor in relation to the vacuum painting chamber.

An apparatus 40 for carrying out the method of the present invention is shown in FIG. 4. The apparatus comprises a sensing means 30 adjacent the take-out conveyor 14, for sensing the leading end E1 of the part P1. The sensing means 30 preferably comprises an optical sensor 30*a*, such as a laser transmitter and receptor. Alternatively, a mechanical sensor such as an interrupter in the path of the part could be used, or any equivalent sensing means.

Figure 5:
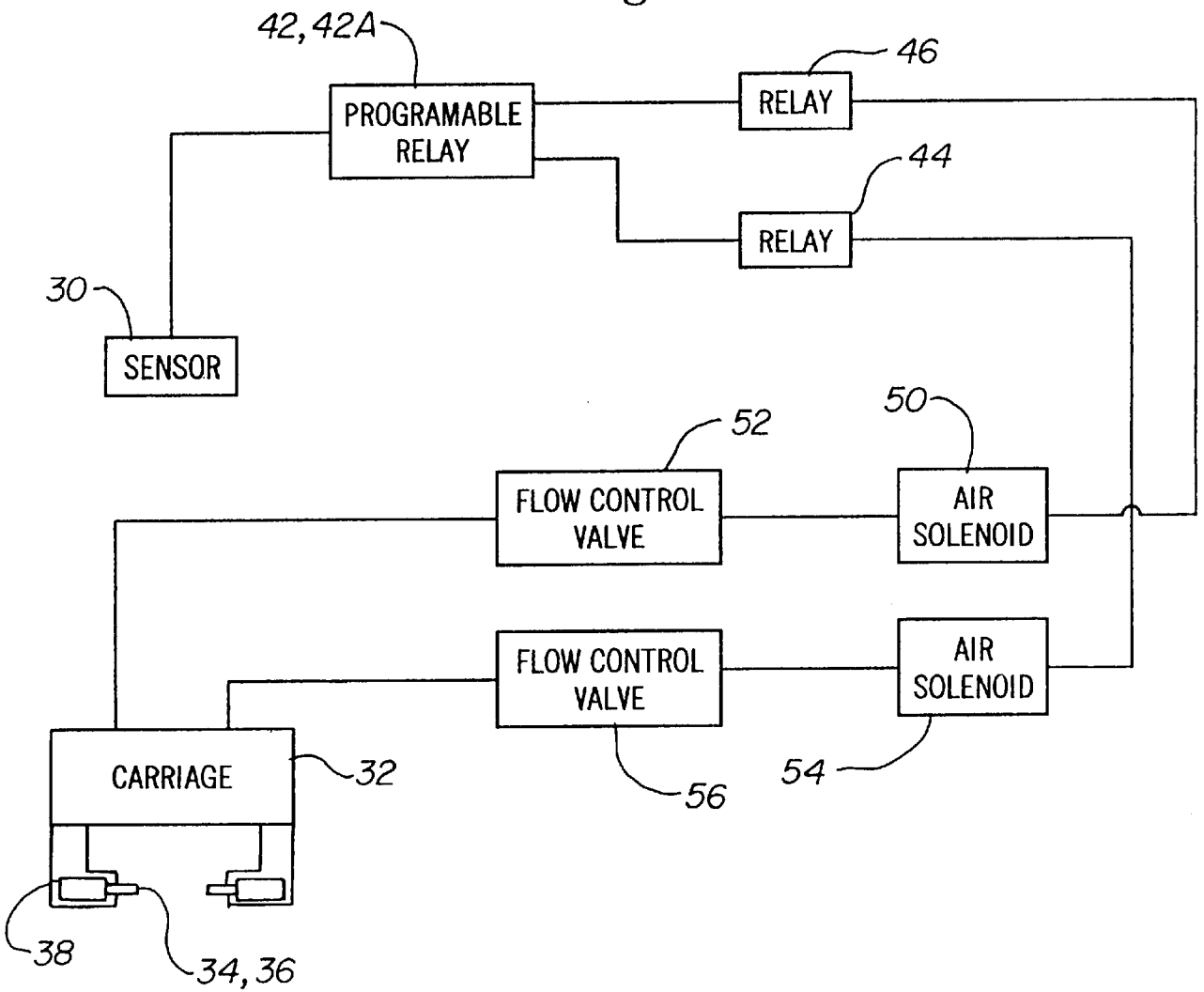
FIG. 5 is a schematic block wiring and air connection diagram of the apparatus of the present invention.

The apparatus 40 (FIG. 5) further comprises a relay means 42 responsive to the sensing means 30. Preferably, the relay means 42 is electronic and receives a signal from the optical sensor 30*a* when the leading edge E1 of the first part P2 interrupts the optical sensor 30*a*. Most preferably, the relay means 42 is a programmable relay 42*a* which may control multiple relays 44, 46 at different time intervals as will be further discussed below.

The apparatus 40 also comprises a movable carriage 32 adjacent the take-out conveyor 14 adapted to move in either direction along the take-out conveyor 14 and positionable along the first part P1 on the take-out conveyor 14. The motion of the carriage 32 is responsive to the relay means 42.

The apparatus 40 also comprises a gripping means 34 mounted on the movable carriage 32 for gripping the first part P1. The gripping means 34 is also responsive to the relay means 42. Preferably, the gripping means 34 comprises a pair of pins 36, one on either side of the part P1, the pins 36 being driven to engage and release the part P1. The gripping means 34 also comprises pistons 38 driving the pins 36, the pistons 38 being driven by a first air solenoid 50. Other equivalent gripping means such as frictional pads or suction cups could also be used.

The apparatus 40 may also preferably comprise a first flow control valve 52 between the first air solenoid 50 and the pistons 38, the flow control valve 52 being adapted to regulate the speed at which the pistons 38 drive the pins 36 toward and away from the part P1.

The apparatus 40 also preferably comprises a second air solenoid 54 driving the movable carriage 32 and a second flow control valve 56 between the second air solenoid 54 and the carriage 32, the flow control valve 56 being adapted to regulate the speed at which the movable carriage 32 moves along the part P1.

Operation of the apparatus 40 is as follows. When the optical sensor 30*a* detects the leading E1 of the first part P1, a signal is sent to the programmable relay 42*a*. The distance at which the optical sensor 30*a* is positioned from the vacuum painting chamber 12 is set so that the trailing end E2 of part P1 will be within the vacuum painting chamber 12 when the leading end E1 trips the sensor 30*a*. Thus, parts of different length will require the sensor 30*a* to be adjustably positionable along the take-out conveyor 14. Most preferably, the trailing end E2 of part P1 will be about one-half inch within the vacuum painting chamber 12 from the entrance seal 18 when the sensor is tripped.

The programmable relay 42*a* then closes relay 44, in turn causing second air solenoid 54 to activate and move the carriage 32 toward the vacuum painting chamber 12.

After a time interval, set in programmable relay 42, the direction of travel of carriage 32 is reversed, and the carriage 32 moves away from the vacuum painting chamber 12 at a speed approaching that of the conveyor 14. Speed matching will minimize the chance of causing the paint along the sides of the part to streak due to contact with the gripping pins 36.

After another time interval, programmable relay 42 causes relay 46 to close, activating first air solenoid 50 which in turn causes the gripper pins 36 to close and engage the part P1. Programmable relay 42 then causes the carriage 32 to move away from the vacuum painting chamber 12 a slight distance, to separate the trailing end of part P1 from the leading end of part P2. Coating in the chamber 12 then coats trailing end E2 and leading end E1.

Programmable relay 42 then causes gripping pins 36 to release the part P1. Part P2, driven by feed conveyor 10, then pushes against part P1, pushing part P1 out of the vacuum painting chamber 12.

The time intervals for the various events discussed above may be adjustable to accommodate different part lengths and different conveyor speeds.

In addition, flow control valves 52, 56 may be adjusted to control the speeds at which the carriage 32 moves and at which the pins 36 close.

Preferably, the apparatus 40 is mounted on a frame 60 with ground-contacting wheels 62 so that the apparatus may be moved from one take-out conveyor to another. In a minimal configuration, the sensing means 30, carriage 32, and gripping means 34 are mounted on the frame. More optimally, the relay means 42, solenoids 50,54, and flow control valves 52, 56 are also mounted on the frame 60.

Preferably, the apparatus 40 also includes first adjustment means 70 for adjusting the carriage 32 and the gripping means 34 vertically in relation to the take-out conveyor 14, to accommodate various heights of the conveyor 14 off the ground. The apparatus 40 may also include second adjustment means 80 for adjusting the carriage 32 and gripping means 34 horizontally in relation to the vacuum painting chamber. The apparatus 40 may also include third adjustment means 90 for adjusting the gripping means 34 horizontally in relation to the part, to accommodate various part widths. The apparatus 40 may also include fourth adjustment means 100 for adjusting the sensing means 30 horizontally in relation to the vacuum painting chamber, to accommodate various part lengths.

In the preferred embodiment, first adjustment means 70 may comprise a first gear rack 72 and first adjusting wheel 74, the movable carriage 32 being moved vertically along the first gear rack 72 by turning first adjusting wheel 74.

Second adjustment means 80 preferably comprises a second gear rack 82 and second adjusting wheel 84, the movable carriage being moved horizontally along the second gear rack 82 by turning second adjusting wheel 84.

Third adjustment means 90 preferably comprises a first slot 92 and a first adjustment pin 94 slidingly engaged with the first slot 92, the gripping means 34 being attached to the first adjustment pin 94.

Fourth adjustment means 100 preferably comprises second slot 102 and second adjustment pin 104 slidingly engaged with the second slot 102, the sensing means 30 being attached to the second adjustment pin.

Optionally, rollers 110 may be used to move the part from the vacuum painting chamber onto the take-out conveyor 14.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An apparatus for six-sided painting of parts, such as boards, the parts having a top, bottom, sides, and ends, in a vacuum painting system having a feed conveyor, a vacuum painting chamber, and a take-out conveyor wherein the a first part is placed end-to-end with a second part on the feed conveyor, each part having a leading end and a trailing end, and the first part and second part enter the vacuum painting chamber end-to-end, the parts exiting the vacuum painting chamber onto the take-out conveyor end-to-end with the leading end of each part exiting the vacuum painting chamber first, said apparatus comprising:

(a) sensing means for sensing the leading end of the first part;

(b) relay means responsive to said sensing means;

(c) a movable carriage adjacent the take-out conveyor and adapted to move in either direction along the take-out conveyor and positionable along the first part on the take-out conveyor, the motion of said movable carriage being responsive to said relay means; and (d) gripping means mounted on said movable carriage for gripping the first part, said gripping means being responsive to said relay means, said relay means, carriage, and gripping means cooperating to move the trailing end of the first part away from the leading end of the second part within the vacuum painting chamber.

2. The apparatus of claim 1, wherein said sensing means comprises an optical sensor.

3. The apparatus of claim 2, wherein said sensing means further comprises a laser transmitter and receptor.

4. The apparatus of claim 1, wherein said relay means is electronic.

5. The apparatus of claim 4, wherein said relay means is programmable.

6. The apparatus of claim 1, wherein said gripping means further comprises a pair of pins, one on either side of the part, said pins being driven to engage and release the part.

7. The apparatus of claim 6, further comprising a pair of pistons driving said pins and a first air solenoid driving said pistons.

8. The apparatus of claim 7, further comprising a first flow control valve between said first air solenoid and said pistons, said first flow control valve being adapted to regulate the speed at which said pistons drive said pins toward and away from the part.

9. The apparatus of claim 8, further comprising a second air solenoid driving said movable carriage and a second flow control valve between said second air solenoid and said movable carriage, said second flow control valve being adapted to regulate the speed at which said movable carriage moves along the first part.

10. The apparatus of claim 1, further comprising a frame with ground-contacting wheels adapted to move from the take-out conveyor to another take-out conveyor, said sensing means, said movable carriage, and said gripping means being mounted on said frame.

11. The apparatus of claim 10, further comprising a first adjustment means for adjusting said movable carriage and said gripping means vertically in relation to the take-out conveyor, second adjustment means for adjusting said movable carriage and said gripping means horizontally in relation to the vacuum painting chamber, third adjustment means for adjusting said gripping means horizontally in relation to the part, and fourth adjustment means for adjusting said sensing means horizontally in relation to the vacuum painting chamber.

12. The apparatus of claim 11, wherein said first adjustment means comprises a first gear rack and first adjusting wheel, said movable carriage and said gripping means being moved vertically along said first gear rack by turning said first adjusting wheel.

13. The apparatus of claim 11, wherein said second adjustment means comprises a second gear rack and second adjusting wheel, said movable carriage and said gripping means being moved horizontally along said second gear rack by turning said second adjusting wheel.

14. The apparatus of claim 1, wherein said third adjustment means comprises a first slot and a first adjustment pin slidingly engaged with said first slot, said gripping means being attached to said first adjustment pin.

15. The apparatus of claim 11, wherein said fourth adjustment means comprises a second slot and a second adjustment pin slidingly engaged with said second slot, said sensing means being attached to said second adjustment pin.

16. The apparatus of claims 9 and 10, wherein said relay means, said first air solenoid, said first flow control valve, said second air solenoid, and said second flow control valve are mounted on said frame.

17. An apparatus for six-sided painting of parts, such as boards, the parts having a top, bottom, sides, and ends, in a vacuum painting system having a feed conveyor, a vacuum painting chamber, and a take-out conveyor wherein the a first part is placed end-to-end with a second part on the feed conveyor, each part having a leading end and a trailing end, and the first part and second part enter the vacuum painting chamber end-to-end, the parts exiting the vacuum painting chamber onto the take-out conveyor end-to-end with the leading end of each part exiting the vacuum painting chamber first, said apparatus comprising:

(a) an optical sensor adjacent the take-out conveyor for sensing the leading end of the first part;

(b) a programmable relay responsive to said optical sensor;

(c) a movable carriage adjacent the take-out conveyor and adapted to move in either direction along the take-out conveyor and positionable along the first part on the take-out conveyor, the motion of said movable carriage being responsive to said programmable relay; and (d) gripping pins mounted on said movable carriage for gripping the first part, said gripping pins being responsive to said programmable relay,said programmable relay, carriage, and gripping pins cooperating to move the trailing end of the first part away from the leading end of the second part within the vacuum painting chamber.

18. The apparatus of claim 17, further comprising a pair of pistons driving said pins and a first air solenoid driving said pistons.

19. The apparatus of claim 18, further comprising a first flow control valve between said first air solenoid and said pistons, said first flow control valve being adapted to regulate the speed at which said pistons drive said pins toward and away from the part.

20. The apparatus of claim 19, further comprising a second air solenoid driving said movable carriage and a second flow control valve between said second air solenoid and said movable carriage, said second flow control valve being adapted to regulate the speed at which said movable carriage moves along the first part.

21. The apparatus of claim 17, further comprising a frame with ground-contacting wheels adapted to move from the take-out conveyor to another take-out conveyor, said optical sensor, said movable carriage, and said gripping pins being mounted on said frame.

22. The apparatus of claim 17, further comprising a first gear rack and first adjusting wheel for adjusting said movable carriage and said gripping pins vertically in relation to the take-out conveyor, second gear rack and second adjusting wheel for adjusting said movable rack and said gripping pins horizontally in relation to the vacuum painting chamber, first slot and first adjustment pin for adjusting said gripping pins horizontally in relation to the part, and second slot and second adjustment pin for adjusting said optical sensor horizontally in relation to the vacuum painting chamber.

23. The apparatus of claims 20 and 21, wherein said programmable relay, said first air solenoid, said first flow control valve, said second air solenoid, and said second flow control valve are mounted on said frame.

* * * * *

UNITED STATES PATENT AND TRADEMARK OFFICE

CERTIFICATE OF CORRECTION

PATENT NO. : 6,013,135
DATED : January 11, 2000
INVENTOR(S) : Robert H. Kaun; David J. Peterson It is certified that error appears in the above-identified patent and that said Letters Patent is hereby corrected as shown below:

Column 7,
Line 15, please delete the numeral "1" and insert in its place the numeral -- 11 --.

Signed and Sealed this

Second Day of October, 2001

*Attest:*

Nicholas P. Godici

*Attesting Officer*

NICHOLAS P. GODICI
*Acting Director of the United States Patent and Trademark Office*